US010739026B2

(12) United States Patent
Wu et al.

(10) Patent No.: US 10,739,026 B2
(45) Date of Patent: Aug. 11, 2020

(54) VENTILATING FAN

(71) Applicants: Panasonic Ecology Systems Guangdong Co., Ltd., Guangdong (CN); Panasonic Corporation, Osaka (JP)

(72) Inventors: Qiming Wu, Guangdong (CN); Shuto Nonoshita, Aichi (JP)

(73) Assignees: Panasonic Corporation, Osaka (JP); Panasonic Ecology Systems Guangdong Co., Ltd., Foshan, Guangdong (CN)

( * ) Notice: Subject to any disclaimer, the term of this patent is extended or adjusted under 35 U.S.C. 154(b) by 277 days.

(21) Appl. No.: 15/866,815

(22) Filed: Jan. 10, 2018

(65) Prior Publication Data

US 2018/0195750 A1 Jul. 12, 2018

(30) Foreign Application Priority Data

Jan. 12, 2017 (CN) ..... 2017 2 0048431 U

(51) Int. Cl.
*F24F 11/00* (2018.01)
*F24F 11/74* (2018.01)
(Continued)

(52) U.S. Cl.
CPC ..... *F24F 11/0008* (2013.01); *F24F 7/013* (2013.01); *F24F 11/0001* (2013.01);
(Continued)

(58) Field of Classification Search
CPC .... F24F 11/0001; F24F 7/013; F24F 2110/20; F24F 13/22; F24F 7/025; F24F 3/0522; G01N 19/10; G01N 25/56; G01N 1/2273; G01N 2291/0215; G01N 2001/2223; G01N 2001/2261; G01N 2001/2267; G01N 25/62; G01N 27/121; G01D 11/30; Y10S 236/19
(Continued)

(56) References Cited

U.S. PATENT DOCUMENTS 6,263,685 B1 * 7/2001 Strobel ..... B60H 1/00792 236/DIG. 19
2004/0079094 A1 * 4/2004 Kasai ..... F24F 1/0007 62/186
2006/0042410 A1 * 3/2006 Arar ..... G01D 11/245 73/866.5

FOREIGN PATENT DOCUMENTS

CN 202091216 * 12/2011 ..... F04D 25/08
CN 202091216 U * 12/2011

* cited by examiner

*Primary Examiner* — Steven B McAllister
*Assistant Examiner* — Charles R Brawner
(74) *Attorney, Agent, or Firm* — RatnerPrestia

(57) ABSTRACT

A ventilating fan, includes a humidity sensor box, provided with an air inlet in a bottom surface facing an suction opening and an air outlet in a top surface opposite to the bottom surface; a humidity sensor located inside the humidity sensor box and adapted to detect the humidity of the air passing through the humidity sensor box; and a humidity sensor circuit board located inside the humidity sensor box, disposed perpendicular to the bottom surface and adapted to control the humidity sensor. The air may flow at a high speed in the humidity sensor box, and it is easy for the water vapor to be taken out of the humidity sensor box without being accumulated inside the humidity sensor box, thereby suppressing the influence of the water vapor or the water droplet on the humidity sensor and enabling the humidity sensor to accurately detect the indoor humidity.

10 Claims, 8 Drawing Sheets

(51) Int. Cl.

| | |
|---|---|
| ***F24F 13/22*** | (2006.01) |
| ***F24F 110/20*** | (2018.01) |
| ***F24F 7/02*** | (2006.01) |
| ***F24F 7/013*** | (2006.01) |

(52) U.S. Cl.
CPC ..... *F24F 11/74* (2018.01); *F24F 13/222* (2013.01); *F24F 7/025* (2013.01); *F24F 2110/20* (2018.01)

(58) Field of Classification Search
USPC ..... 454/239, 243, 244, 248, 249, 251, 292, 454/329; 73/24.04, 335, 29.01, 29.02, 73/31.01, 31.02, 31.03, 866.5
See application file for complete search history.

VENTILATING FAN

CROSS REFERENCE TO RELATED APPLICATIONS

This application claims priority to Chinese Application No. 201720048431.4, filed Jan. 12, 2017, the contents of such application being incorporated by reference herein.

BACKGROUND OF THE INVENTION

Field of the Invention

The present disclosure relates to a ventilating fan, in particular to a ventilating fan with a humidity sensor.

Description of the Related Art

In order to make the ventilating fan run automatically according to the change of ambient environment, the existing ventilating fan is generally equipped with a body sensor, a humidity sensor, a carbon monoxide sensor and the like, and real-time detection to the ambient environment is performed by the various sensors, and the ventilating fan is controlled to turn on/off or change operation speed, according to the detecting result, such as a ventilating fan with a humidity sensor as described in China utility model patent ZL201320384615.X.

FIG. 1 is a schematic structural view of a ventilating fan in the conventional art. As shown in FIG. 1, the conventional ventilating fan comprises: a frame 1 provided with an opening 4 at an indoor side, a casing 2 provided in the frame 1, an air blower 3 provided in the frame 1, and a humidity sensor provided in the casing 2. When the humidity sensor detects that the indoor air reaches certain humidity, the air blower 3 of the ventilating fan will automatically run so as to discharge the indoor moist air to the outdoors and thus achieve the purpose of dehumidification.

When the ventilating fan with the humidity sensor is placed in a hot and humid environment like a bathroom, in order to prevent the water vapor in the air from being liquefied into water droplets and being collected on the humidity sensor or prevent the shower water from splashing on the humidity sensor which may results in a short life expectancy and a low sensing accuracy for the humidity sensor, the humidity sensor will generally be disposed in a waterproof box 5.

An air inlet is provided in a bottom surface 7 of the waterproof box 5 facing the inside of the room, and the air outlet is provided in a side surface 6 adjacent to the bottom surface. When the indoor air is sucked by the air blower, a part of the air enters the waterproof box 5 through the air inlet, comes into contact with the humidity sensor in the waterproof box 5, and then is discharged through the air outlet.

Under the drawing of the air blower 3, the air enters the waterproof box 5 from the air inlet on the bottom surface 7 facing the inside of the room, and then the direction thereof is required to be changed so as to be discharged out of the waterproof box 5 from the air outlet in the side surface 6 adjacent to the bottom surface 7. The air abounds with water vapor, and is liable to be detained in the waterproof box 5 during the flow process and may not be taken out. So even if the indoor humidity has been reduced, but due to the water vapor inside the waterproof box 5, the humidity sensor may still detect a high humidity, resulting in a continuous operation of the ventilating fan. In other words, the humidity sensor has a decreased sensing accuracy, and may not accurately or precisely detect the indoor humidity.

SUMMARY OF THE INVENTION

I: The Problem to be Solved

In order to solve the above problems, the present disclosure provides a ventilating fan which may suppress the influence of water vapor or water droplet on the humidity sensor and enable the humidity sensor to accurately detect the indoor humidity.

II: Technical Solution

The present disclosure provides a ventilating fan, comprising: a frame provided with a suction opening; a louver provided with an air intake for allowing air to enter into the frame; wherein the ventilating fan further comprising: a humidity sensor box provided with an air inlet in a bottom surface facing the suction opening and an air outlet in a top surface opposite to the bottom surface; a humidity sensor, located inside the humidity sensor box and adapted to detect the humidity of the air passing through the humidity sensor box; and a humidity sensor circuit board located inside the humidity sensor box, disposed perpendicular to the bottom surface and adapted to control the humidity sensor.

Preferably, a sensing surface of the humidity sensor configured to detect the humidity of the air is perpendicular to the bottom surface.

Preferably, the humidity sensor box comprises a box body and a box lid, the box body is provided with an opening at a bottom surface side, the box lid comprises an inner box lid provided at a box body side and covering the opening, and an outer box lid located outside the inner box lid, and the humidity sensor circuit board is disposed in a space inside the box body.

Preferably, the outer box lid is provided with a first air inlet and the inner box lid is provided with a second air inlet; the position of the first air inlet and the position of the second air inlet are offset from each other; and a space for allowing air to pass through is provided between the outer box lid and the inner box lid.

Preferably, a surface of the humidity sensor circuit board for installing the humidity sensor thereon is parallel to the sensing surface of the humidity sensor, positioning structures for fixing the humidity sensor circuit board are arranged inside the box body, and in a state that the humidity sensor circuit board is installed in a space inside the box body based on the positioning structures, the sensing surface of the humidity sensor is parallel to a surface for connecting the bottom surface to the top surface.

Preferably, the box body has a first sidewall and a second sidewall opposite to the first sidewall, wherein the first sidewall has a height larger than that of the second sidewall, the outer box lid is snapped to an outer surface of the second sidewall, and the inner box lid is snapped to an inner surface of the first sidewall.

Preferably, an inner surface of the first sidewall of the box body is provided with a recess recessed toward an outside of the box body, and a sidewall of the inner box lid opposite to the first sidewall of the box body is provided with a protrusion that is snapped into the recess.

Preferably, an outer surface of the second sidewall of the box body is provided with a snap hook protruding toward an outside of the box body, and a sidewall of the outer box lid corresponding to the second sidewall of the box body is provided with a snap opening for engaging with the snap hook.

Preferably, the snap hook comprises a detachment-preventing structure, in an engagement of the snap hook and the snap opening, the detachment-preventing structure is configured such that a force for releasing the engagement is much larger than a force for snapping the outer box lid onto the box body.

Preferably, the detachment-preventing structure comprises: a tilting snap surface tilted away from the second sidewall in a direction from the air inlet to the air outlet; and a tilting detachment-preventing surface tilted away from the second sidewall in a direction from the air outlet to the air inlet; the tilting detachment-preventing surface has a larger inclination with respect to the second sidewall than that of the tilting snap surface.

Preferably, the inner box lid presses the humidity sensor circuit board against the top surface of the humidity sensor box such that the humidity sensor circuit board is fixed thereon.

Preferably, the air outlet has two or more orifices and the diameter of the orifice is in a range of 1.5 mm to 2 mm.

III: Beneficial Effects

1. The air may flow at a high speed in the humidity sensor box, and it is easy for the water vapor to flow out of the humidity sensor box with the flow without being accumulated inside the humidity sensor box, thereby suppressing the influence of the water vapor or the water droplet on the humidity sensor and enabling the humidity sensor to accurately detect the indoor humidity;

2. since the diameter of the orifice of the air outlet of the humidity sensor box is small enough, surface tension of the water may prevent the water droplet from entering into the humidity sensor box through the orifices, thereby preventing decreasing of the detection accuracy of the humidity sensor;

3. positions of the first air inlet of the outer box lid and the position of the second air inlet of the inner box lid are offset from each other, thereby effectively preventing the water droplet from entering into the box body; and 4. the entire assembly process does not require screws and the like, and the box lid and the box body are fitted together by a hinge, and the number of components is small and the assembly is simple, thereby improving the simplicity of the assembly and saving manufacturing time.

DESCRIPTION OF REFERENCE NUMERALS

Conventional Art

1—frame; 2—casing; 3—air blower; 4—opening; 5—waterproof box; 6—side surface; 7—bottom surface The Present Disclosure

10—frame; 11—suction opening; 12—discharge opening; 13—adapter; 14—circuit board box; 15—power supply box; 16—ceiling;

20—louver; 21—air intake;

30—casing; 31—air blower; 311—motor; 312—fan;

40—humidity sensor box; 41—humidity sensor; 411—sensing surface, 42—humidity sensor circuit board; 43—air inlet; 44—air outlet; 45—quick—connect terminal; 46—top surface; 47—bottom surface;

48—box body; 481—positioning sheet; 482—positioning block; 483—first sidewall; 484—second sidewall; 485—recess; 486—snap hook; 487—tilting snap surface; 488—tilting detachment—preventing surface; 489—opening;

49—box lid; 491—outer box lid; 492—inner box lid; 493—first air inlet; 494—second air inlet; 495—space; 496—protrusion; 497—snap opening.

DETAILED DESCRIPTION OF PREFERRED EMBODIMENTS OF THE INVENTION

To make the objectives, technical solutions and advantages of the present disclosure clearer, the present disclosure is further described in detail below in combination with the detailed embodiments with reference to the accompanying drawings.

Figure 1:
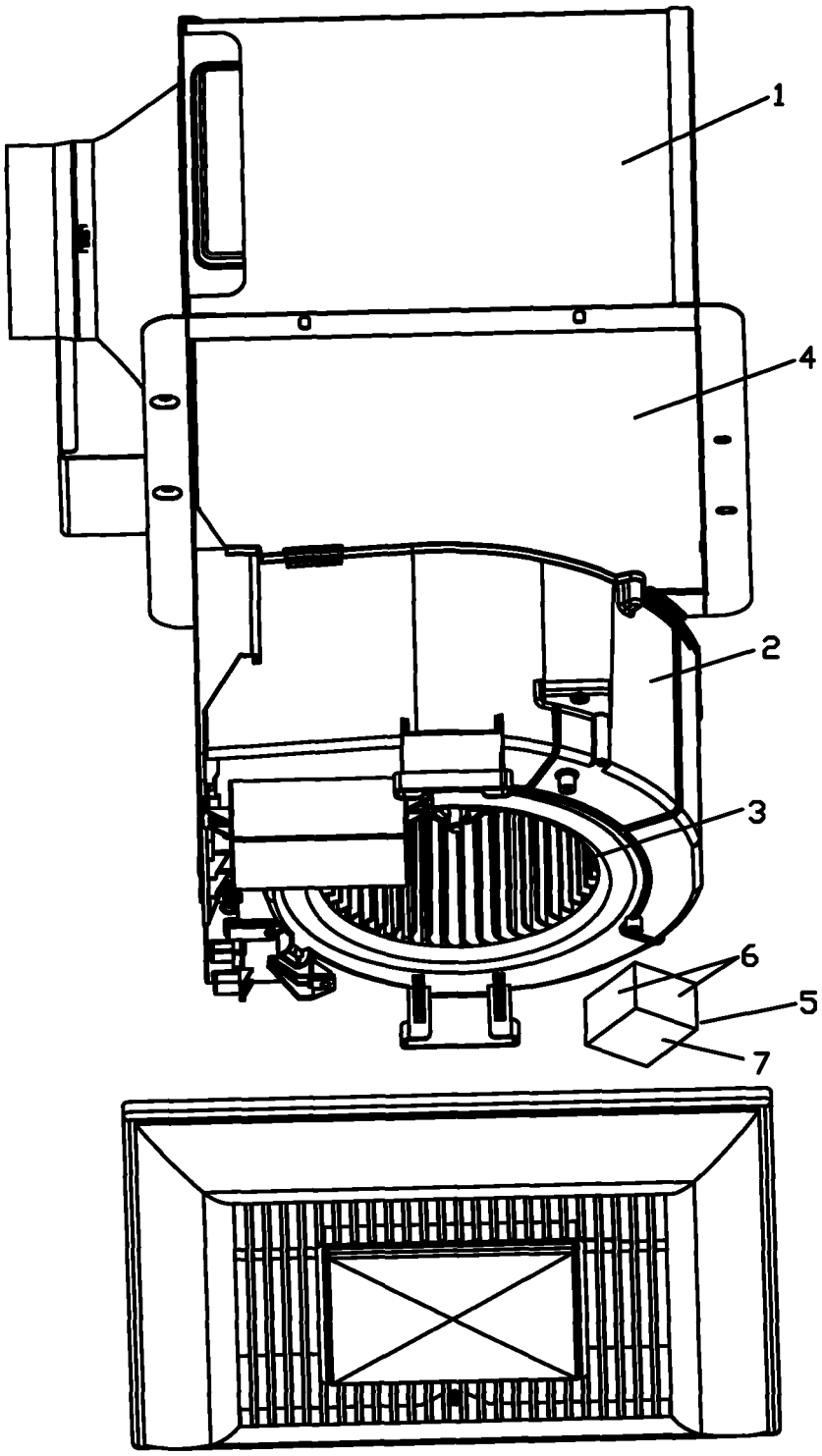
Fig.1 PRIOR ART
FIG. 1 is a schematic structural view of a ventilating fan in the conventional art.
Figure 2:
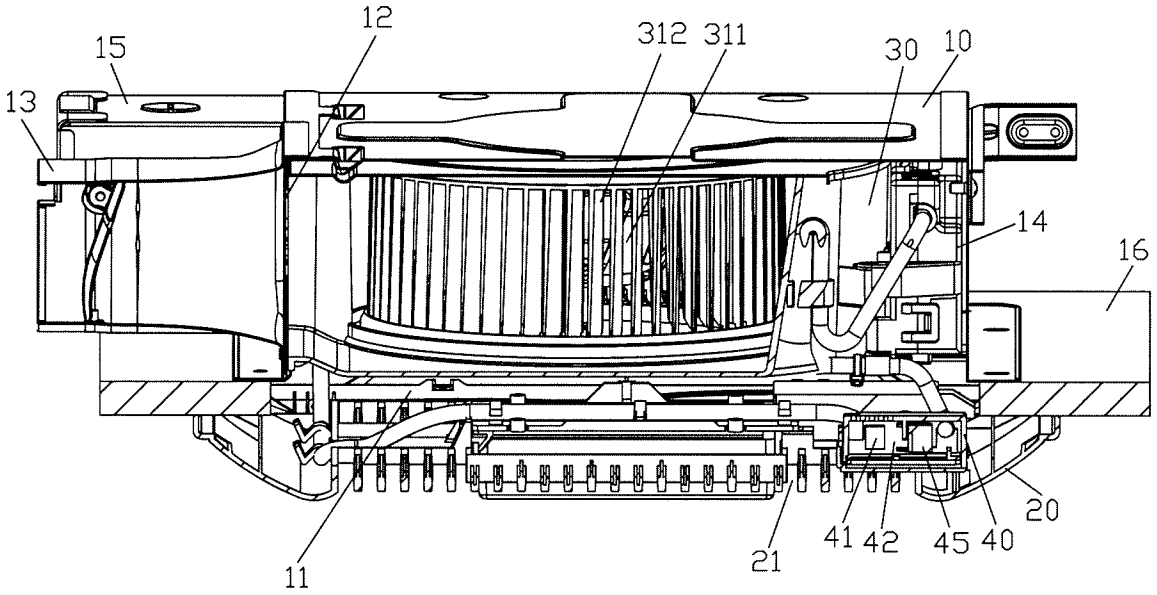
FIG. 2 is a schematic structural view of a ventilating fan according to an embodiment of the present disclosure.
Figure 3A:
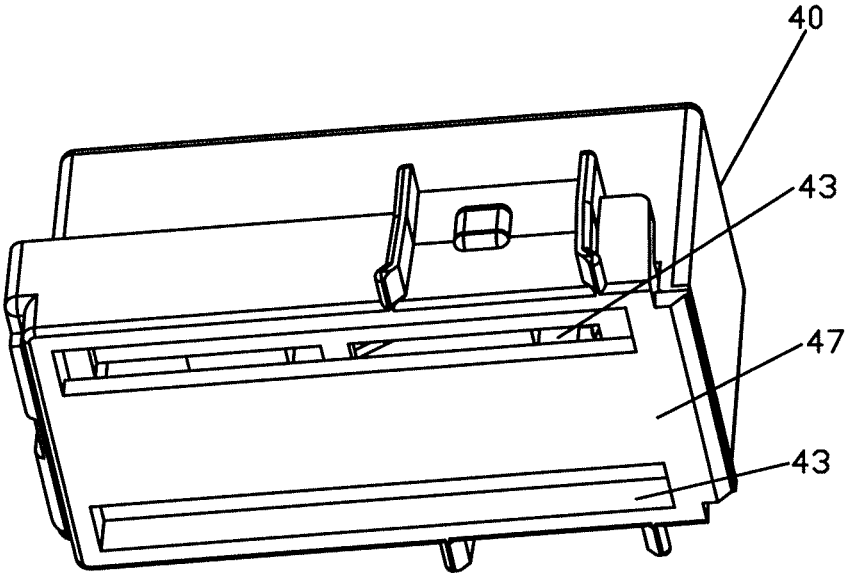
FIG. 3*a* and FIG. 3*b* are schematic views of a humidity sensor box of a ventilating fan viewed from different angles according to an embodiment of the present disclosure, respectively.
Figure 3B:
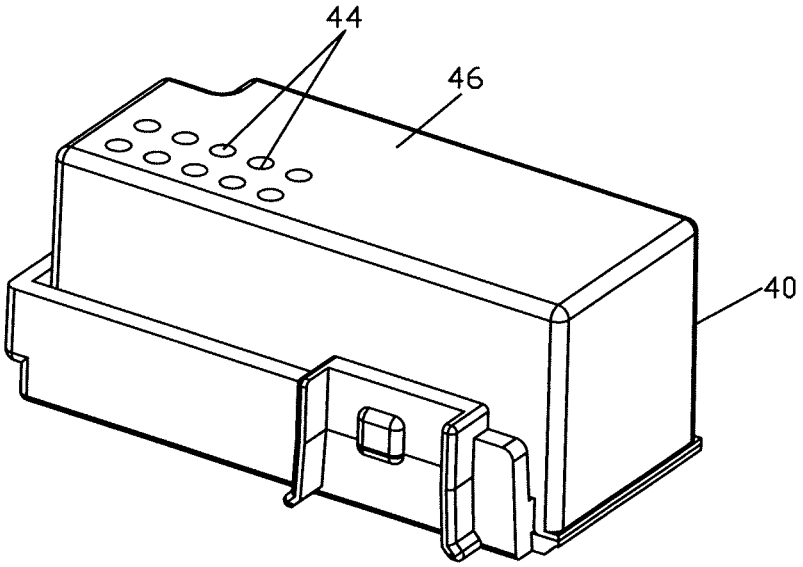

The ventilating fan according to an embodiment of the present disclosure, as shown in FIG. 2, may be installed in a space between the ceiling 16 and the roof and may also be installed on the wall. In the specification and claims of the present disclosure, the terms "bottom", "top", "horizontal", "longitudinal" and the like are used to indicate the orientations or the positional relationship of various components, on the basis that the ventilating fan is installed in the space between the ceiling 16 and the roof. The terms for indicating the orientations or the positional relationship of the various components are merely for convenience and simplification of description of the present disclosure, rather than indicating or implying that the indicated device or element must have a specific orientation, and therefore may not be construed as a limitation to the present disclosure.

Referring to FIGS. 2, 3*a*, 3*b* and 4*a*, the ventilating fan according to the embodiment of the present disclosure includes a frame 10, a louver 20, a humidity sensor box 40, a casing 30, an air blower 31, a circuit board box 14, and a power supply box 15.

The frame 10 has a hollow rectangular parallelepiped shape, and is provided with a suction opening 11, and a discharge opening 12 for discharging the air already entering into the frame 10 in any surface adjacent to the surface where the suction opening is disposed. An adapter 13 is provided at an air downstream side of the discharge opening 12, and is connected to a ventilation duct.

The louver 20 is provided with an air intake 21 for allowing air to enter into the frame 10.

The humidity sensor box 40 is provided with an air inlet 43 in a bottom surface 47 facing the suction opening, and an air outlet 44 in a top surface 46 opposite to the bottom surface 47.

The humidity sensor box 40 is further provided with s a humidity sensor 41 and a humidity sensor circuit board 42 therein. The humidity sensor 41 is located inside the humidity sensor box 40 and adapted to detect the humidity of the air passing through the humidity sensor box 40. The humidity sensor circuit board 42 is located inside the humidity sensor box 40, disposed perpendicular to the bottom surface 47 and adapted to control the humidity sensor 41.

The frame 10 is provided with a casing 30 and an air blower 31 therein so as to achieve the ventilation function. In turn, the air blower 31 includes a fan 312 and a motor 311 for driving the fan 312 to rotate. After the motor 311 is energized, the fan 312 is driven to rotate. The air enters the frame 10 through the air intake 21 of the louver 20, and flows to the discharge opening 12 of the frame along the casing 30 by means of the fan 312. The fan 312 may be, but not limited to, a multi-blade fan.

Inside the frame 10, a circuit board box 14 is provided outside the casing 30, and a control circuit board is fixed inside the circuit board box 14. The control circuit board is connected to the air blower 31 and the humidity sensor 41 and configured to control the operation of the air blower 31 after receiving the electrical signal or the signal of the humidity sensor 41.

A power supply box 15 is provided outside the frame 10. The power supply box 15 is provided with electrical components therein, which are connected to the control circuit board through lead wires so as to provide power for the operation of the control circuit board and the air blower 31.

Figure 4A:
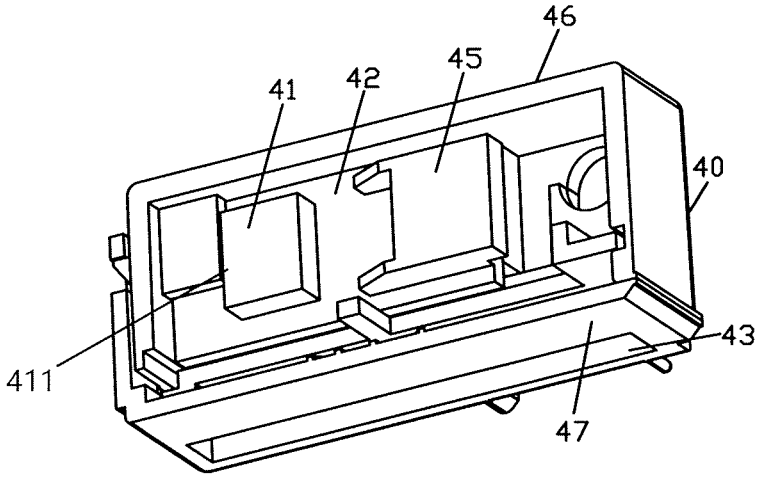
FIG. 4*a* and FIG. 4*b* are cross-sectional schematic views of a humidity sensor box of a ventilating fan viewed from different directions according to an embodiment of the present disclosure, respectively.
Figure 6A:
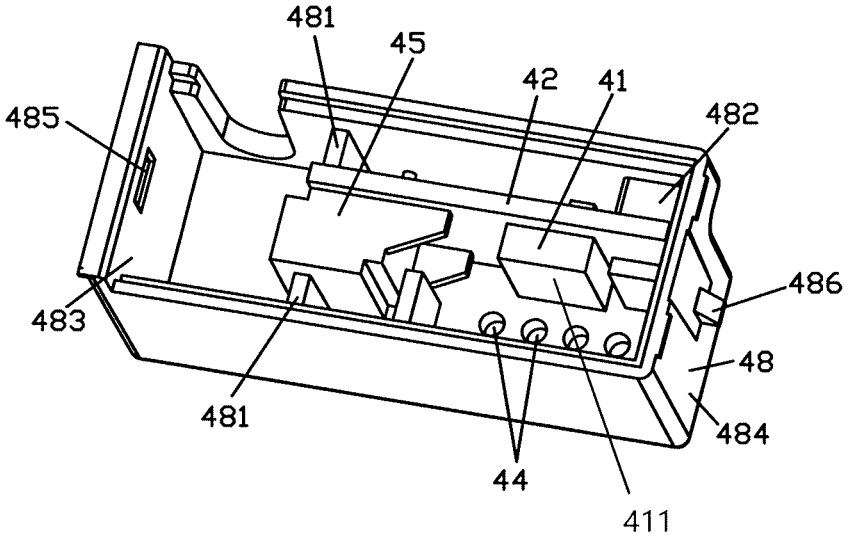
FIG. 6*a* and FIG. 6*b* are schematic structural views of a humidity sensor box of a ventilating fan according to an embodiment of the present disclosure, respectively, in FIG. 6*a* an inner box lid and an outer box lid are omitted, and in FIG. 6*b* the inner box lid is omitted.

The humidity sensor 41 is installed on a small circuit board, and in order to distinguish it from the control circuit board herein, the circuit board on which the humidity sensor 41 is mounted is referred to as a "humidity sensor circuit board". In addition to the humidity sensor 41, the humidity sensor circuit board 42 also carries a quick-connect terminal 45, and the humidity sensor circuit board 42 and the control circuit board are connected electrically to each other by inserting connection terminals at both ends of the lead wire into the quick-connect terminal 45 and a quick-connect terminal on the control circuit board, respectively. The humidity sensor 41 has a sensing surface 411 configured to sense the humidity of the air, as shown in FIGS. 4*a* and 6*a*. When the humidity sensor 41 detects that the indoor humidity is higher or lower than a user preset value, the humidity sensor circuit board 42 sends a signal to the control circuit board such that the control circuit board controls the air blower 31 to start or stop the operation.

In the present disclosure, the humidity sensor circuit board 42 is housed in the humidity sensor box 40 for waterproofing. The humidity sensor box 40 has a generally hollow rectangular parallelepiped shape, and is provided with the air inlet 43 in the bottom surface 47 facing the inside of the room, i.e. the surface facing to the air intake 21 of the louver, and an air outlet 44 in a top surface 46 opposite to the bottom surface 47 in which the air inlet 43 is provided. The humidity sensor circuit board 42 and the bottom surface 47 are disposed perpendicular to each other, that is, the humidity sensor circuit board 42 is vertically disposed in the humidity sensor box 40. At this time, the sensing surface 411 of the humidity sensor 41 is perpendicular to the bottom surface 47.

By means of the above structure, under the drawing of the air blower 31, the air enters into the frame 10 from the air intake 21 of the louver and then flows upwardly to the air blower 31, and at the same time, a part of the air enters into the humidity sensor box 40 through the air inlet 43 of the humidity sensor box after passing through the air intake 21 of the louver, and comes into contact with the humidity sensor 41 and flows upwardly along the humidity sensor circuit board 42 to the air outlet 44, and then continues to flow to the air blower 31. It can be seen that, as compared with the background art, after entering into the air inlet 43 of the humidity sensor box, the air can smoothly flow in the vertical direction to the air outlet 44 in the upper portion under the guidance of the humidity sensor circuit board 42, that is, the flow direction of the air in the humidity sensor box 40 coincides with the flow direction of the air flowing towards the air blower 31 after passing through the air intake 21 of the louver, and the flowing direction of the air is not required to change t after entering into the humidity sensor box 40 so that the air may flow at a high speed in the humidity sensor box 40, and it is easy for the water vapor to flow out of the humidity sensor box 40 with the air flow without being accumulated inside the humidity sensor box 40 to prevent the water vapor accumulated in the humidity sensor box 40 from affecting the detection result of the humidity sensor 41, thereby suppressing the influence of the water vapor or the water droplet on the humidity sensor 41 and enabling the humidity sensor 41 to accurately detect the indoor humidity.

Although the frame 10 is designed as a hollow rectangular parallelepiped shape in this embodiment, the present disclosure is not limited thereto. In the present disclosure, the frame 10 may also be designed to be circular, polygonal, or the like, as long as an accommodating space may be formed therein, in which the components such as the air blower 31 and the circuit board box 14 can be mounted and fixed.

In this embodiment, the air outlet 44 of the humidity sensor box 40 includes two or more orifices, and the diameter of the orifice is in the range of 1.5 mm to 2 mm. Since the air outlet 44 is located on the top surface 46 of the humidity sensor box, i.e., away from the indoor side, the bath water may not enter into the humidity sensor box 40 through the air outlet 44. Moreover, even if a small amount of airborne water vapor forms into water droplets on the top surface 46 of the humidity sensor box, the surface tension of the water may prevent the water droplets from entering into the humidity sensor box 40 through the orifices, due to the small orifice diameter, thereby preventing the water droplets from entering into the humidity sensor box 40 and preventing the detection accuracy of the humidity sensor 41 from decreasing.

Figure 4B:
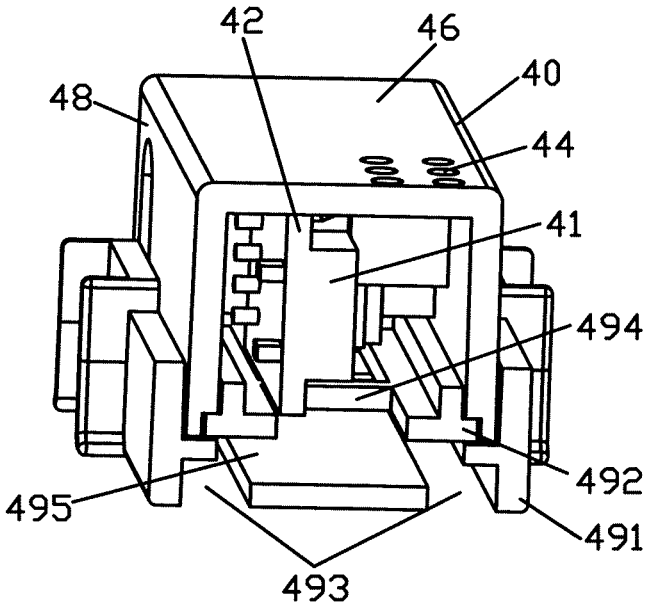
Figure 5:
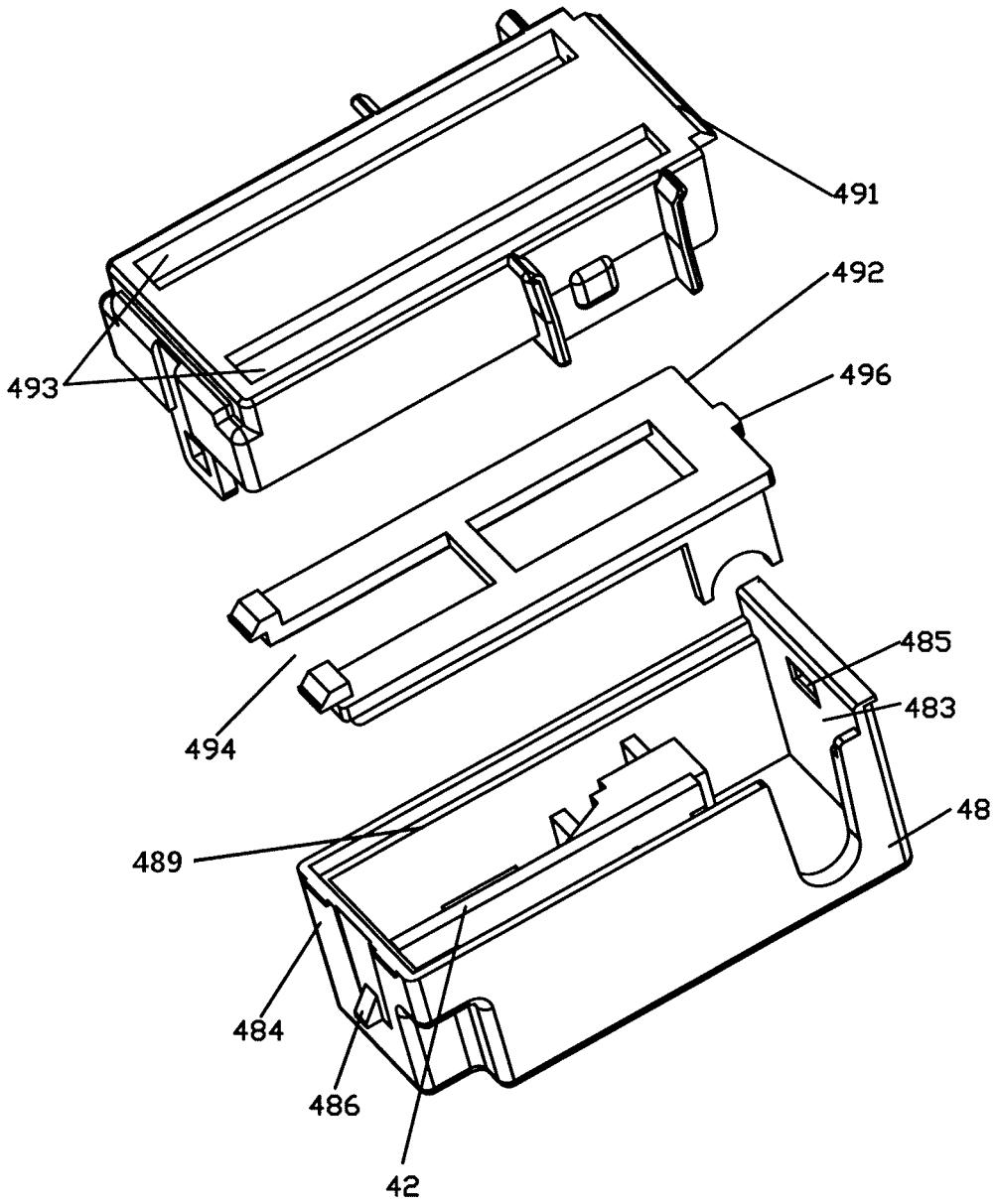
FIG. 5 is an exploded structure view of a humidity sensor box of a ventilating fan according to an embodiment of the present disclosure.

Further, referring to FIG. 4*b* and FIG. 5, the humidity sensor box 40 includes a box lid 49 and a box body 48. The box body 48 is provided with an opening 489 at a bottom surface side 47. The box lid 49 includes an inner box lid 492 provided at a box body side and covering the opening 489, and an outer box lid 491 located outside the inner box lid 492, and the humidity sensor circuit board 42 is disposed in a space inside the box body 48. The inner box lid 492 is provided with a second air inlet 494, and the outer box lid 491 is provided with a first air Inlet 493. The position of the second air inlet 494 and the position of the first air inlet 493 are offset from each other, and a space 495 for allowing the air to pass through is provided between the outer box lid 491 and the inner box lid 492.

In addition, the inner box lid 492 keeps in contact with the humidity sensor circuit board 42, and presses the humidity sensor circuit board 42 against the top surface of the humidity sensor box such that the humidity sensor circuit board 42 is accurately fixed to facilitate the stability of humidity detection.

Since the humidity sensor circuit board 42 is disposed in the space inside the box body 48, the water in the bath can be prevented from splashing on the humidity sensor circuit board 42 by means of the blocking of the inner box lid 492 and the outer box lid 491.

Further, the position of the first air inlet 493 of the outer box lid 491 and the position of the second air inlet 494 of the inner box lid 492 are offset from each other, for example, the first air inlets 493 are provided along two sides of the outer box lid 491, respectively, whereas the second air inlet 494 is provided in the center portion of the inner box lid 492. In this way, although the outer box lid 491 and the inner box lid 492 are both provided with the air inlet, the inner box lid 492 may block the water droplets from entering into the box body 48 even though the water droplets has already passed through the first air inlet 493 of the outer box lid 491, since the second air inlet 494 is not provided in the inner box lid 492 at a position corresponding to the first air inlet 493. That is, the misaligning structure may effectively prevent water droplets from entering into the box body 48.

In addition, a space 495 for allowing the air to pass through is provided between the outer box lid 491 and the inner box lid 492, and the air is introduced from the first air inlets 493 on both sides of the outer box lid 491, gathers in the space 495 between the outer box lid 491 and the inner box lid 492 and then flows toward the second air inlet 494 in the center portion of the inner box lid 492, and then comes into contact with the humidity sensor 41 in the box body 48 and subsequently flows to the air outlet 44 in the top surface 46. In other words, the air may flow at a high speed, such that humidity sensor 41 may accurately detect the humidity while preventing the water droplets from entering into the humidity sensor box 40.

In addition, the inner box lid 492 keeps in contact with the humidity sensor circuit board 42, and presses the humidity sensor circuit board 42 against the top surface of the humidity sensor box such that the humidity sensor circuit board 42 is fixed thereon. In this way, the humidity sensor circuit board 42 is precisely fixed and may facilitate the stability of the humidity sensing.

Figure 6B:
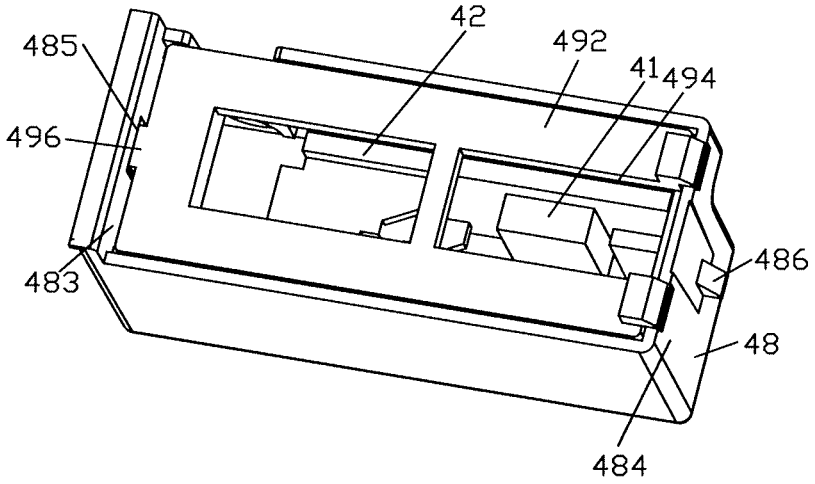

Further, referring to FIG. 6*a* and FIG. 6*b*, two or more positioning structures for fixing the position of the humidity sensor circuit board 42 are provided in the box body 48. In a state that the humidity sensor circuit board 42 is installed in a space inside the box body based on the positioning structures, the sensing surface of the humidity sensor 41 is parallel to a surface for connecting the bottom surface 47 to the top surface 46.

The positioning structures may be a sheet-shaped positioning sheet 481 or a block-shaped positioning block 482. The positioning structures are disposed on the inner wall of the box body 48, and the number thereof may be determined based on the actual size of the humidity sensor circuit board 42, as long as the circuit board 42 may be stably fixed in the box body 48.

The length or the thickness of the positioning structures is adjusted so that after the humidity sensor circuit board 42 is inserted into the space between the positioning structures, the humidity sensor 41 mounted on the humidity sensor circuit board 42 is disposed opposite to the second air inlet 494. In this way, after the air enters from the second air inlet 494, it may sufficiently contact with the humidity sensor 41, so that the humidity sensor 41 may detect the indoor air rapidly and accurately, thereby achieving the effect of maintaining the sensing accuracy of the humidity sensor 41.

Further, referring to FIGS. 5, 6*a*, 6*b* and 7, the outer box lid 491 is hinged to a first sidewall 483 of the box body 48, and the inner box lid 492 is hinged to a second sidewall 484 of the box body 48 opposite to the first sidewall 483. The first sidewall 483 has a height larger than that of the second sidewall 484, and due to the difference in the height, the inner box lid 492 is different from the outer box lid 491 in an up and down direction, so as to form a space 495 there between. An inner surface of the first sidewall 483 of the box body 48 is provided with a recess 485 recessed toward an outside of the box body 48. A sidewall of the inner box lid 492 opposite to the first sidewall 483 of the box body 48 is provided with a protrusion 496 that is snapped into the recess 485. The inner box lid 492 is snapped to an inner surface of the first sidewall 483. An outer surface of the second sidewall 484 of the box body 48 is provided with a snap hook 486 protruding toward an outside of the box body 48, and a sidewall of the outer box lid 491 corresponding to the second sidewall 484 of the box body 48 is provided with a snap opening 497 for engaging with the snap hook 486. The outer box lid 491 is snapped to an outer surface of the second sidewall 484.

The outer box lid 491 is hinged to the first sidewall 483 of the box body 48, and the inner box lid 492 is hinged to the second sidewall 484 of the box body 48 opposite to the first sidewall 483, such that the opening and closing of the outer box lid 491 and the opening and closing of the inner box lid 492 will not interfere with each other. When assembling the humidity sensor box 40, the humidity sensor circuit board 42 is firstly inserted into the box body 48; then the inner box lid 492 is fitted, that's to say, a force is applied such that the protrusion 496 of the inner box lid 492 will be snapped into the recess 485 in the box body 48; and then the outer box lid 491 is fitted, that's to say, a force is applied such that the snap opening 497 of the outer box lid 491 will be snapped onto the snap hook 486 of the box body 48.

Figure 7:
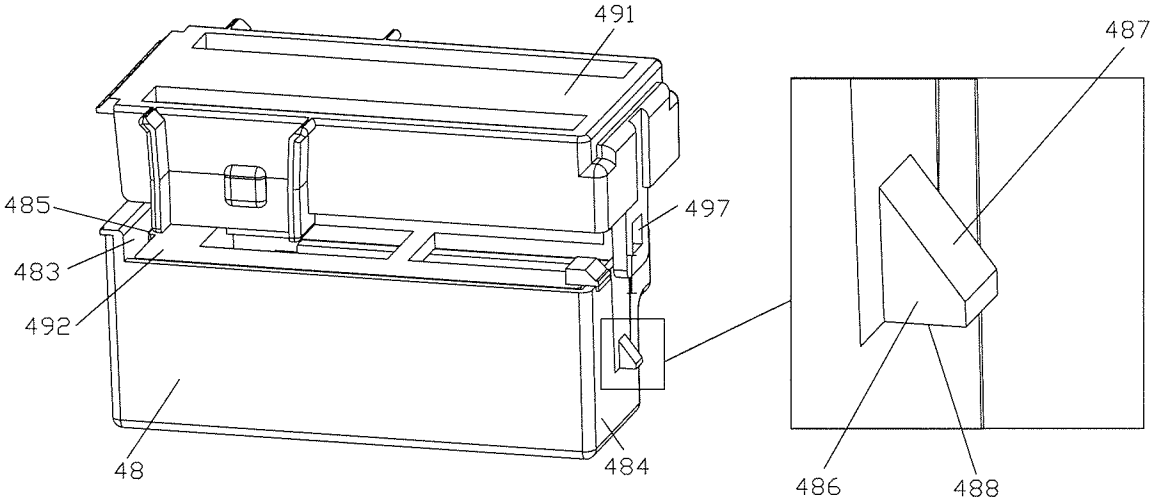
FIG. 7 is an enlarged view of a detachment-preventing structure of a humidity sensor box of a ventilating fan according to an embodiment of the present disclosure.

Referring to FIG. 7, the snap hook 486 includes a detachment-preventing structure, and in the engagement of the snap hook 486 and the snap opening 497, the detachment-preventing structure is configured such that a force for releasing the engagement is much larger than a force for snapping the outer box lid 491 onto the box body 48. To be specific, the detachment-preventing structure includes: a tilting snap surface 487 tilted away from the second sidewall 484 in a direction from the air inlet 43 to the air outlet 44; and a tilting detachment-preventing surface 488 tilted away from the second sidewall 484 in a direction from the air outlet 44 to the air inlet 43. The tilting detachment-preventing surface 488 has a larger inclination with respect to the second sidewall 484 than that of the tilting snap surface 487.

During the fitting operation of the outer box lid 491, the sidewall of the outer box lid 491 corresponding to the second sidewall 484 of the box body 48 is slightly deformed toward the outside of the box body 48 under the guidance of the tilting snap surface 487. Then the snap opening 497 provided in the sidewall of the outer box lid 491 passes over the snap hook 486, such that the original shape of the outer box lid 491 is restored, and then the snap opening 497 snaps on the tilting detachment-preventing surface 488 of the snap hook 486, and the assembly is completed. It can be seen that screws and the like are not required in the entire assembly process and the box lid 49 and the box body 48 are fitted together by a hinge. The number of components is small and the assembly is simple, thereby improving the simplicity of the assembly and saving manufacturing time.

Figure 8:
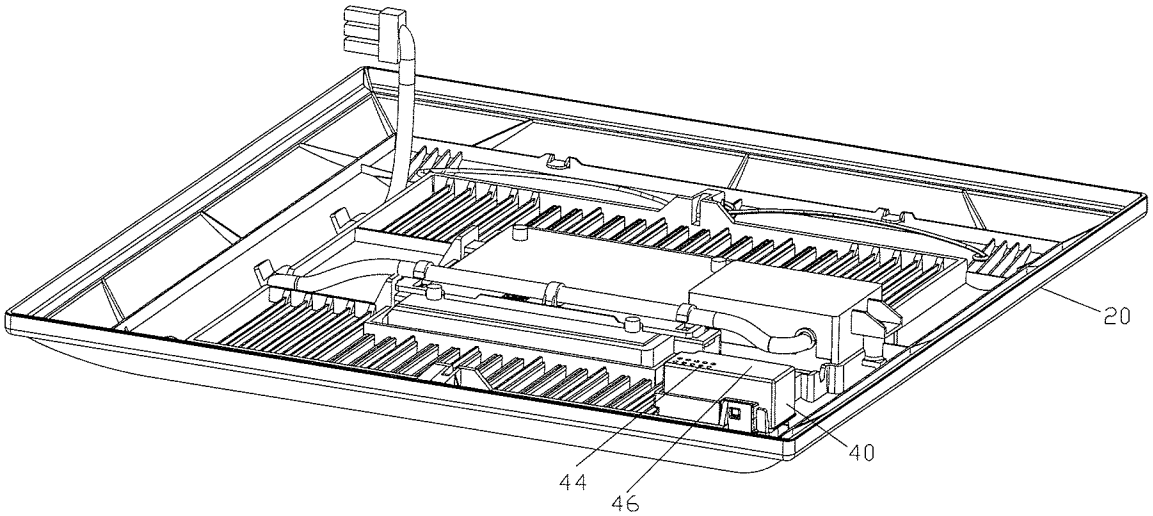
FIG. 8 is a schematic structural view of a humidity sensor box located on a louver of a ventilating fan according to an embodiment of the present disclosure.

Further, referring to FIGS. 2 and 8, the humidity sensor box 40 is disposed on the louver 20. If the humidity sensor box 40 is disposed in the frame 10, for example on a surface of the casing 30 facing the inside of the room, the humidity sensor box 40 is in close contact with the casing 30, the air outlet 44 of the humidity sensor box 40 is blocked by the casing 30 and the air may not be discharged from the air outlet 44. If the humidity sensor box 40 is arranged in the frame 10 at a certain distance from the casing 30, the thickness of the frame 10 will inevitably be increased, which is unfavorable to thinning of the ventilating fan and renders difficulty to the installation of the ventilating fan.

When the ventilating fan is installed on the ceiling 16, the frame 10 and the components in the frame 10 are located in the space between the roof and the ceiling 16, and the louver 20 covers the suction opening 11 of the frame 10 through the ceiling 16. In other words, the louver 20 and the frame 10 are spaced apart from each other by a certain distance in the mounted state.

Therefore, the humidity sensor box 40 is disposed on the louver 20, the air outlet 44 of the humidity sensor box 40 is thus not blocked by the components in the frame 10, and the air may be smoothly discharged from the air outlet 44 in the top surface 46 of the humidity sensor box 40, and then flows to the air blower 31. By providing the humidity sensor box 40 on the louver 20, it is possible to ensure that the air outlet 44 of the humidity sensor box is not blocked and that the frame 10 is made thinner.

Heretofore, the present embodiment has been described in detail with reference to the accompanying drawings. Based on the above description, those skilled in the art should have a clear understanding of the ventilating fan of the present disclosure.

It should be noted that implementations not shown or described in the drawings or the text of the specification are all known to those of ordinary skill in the art and are not described in detail. In addition, the above definition of each element is not limited to the specific structures and shapes mentioned in the embodiments, and may be simply changed or replaced by those of ordinary skill in the art.

The above specific embodiments illustrate the purpose, technical solutions and beneficial effects of the present disclosure in further detail. It should be understood that the above embodiments is only the specific embodiments of the present disclosure and is not intended to limit the present disclosure, any modifications, equivalent substitutions and improvements made within the spirit and principle of the present disclosure should be included in the protection scope of the present disclosure.

What is claimed is:

1. A ventilating fan, comprising:

a frame provided with a suction opening;

a louver provided with an air intake for allowing air to enter into the frame;

wherein the ventilating fan further comprising:

a humidity sensor box provided with an air inlet in a bottom surface facing the suction opening and an air outlet in a top surface opposite to the bottom surface;

a humidity sensor, located inside the humidity sensor box and adapted to detect the humidity of the air passing through the humidity sensor box; and a humidity sensor circuit board located inside the humidity sensor box, disposed perpendicular to the bottom surface and adapted to control the humidity sensor;

the humidity sensor box comprises a box body and a box lid, the box body is provided with an opening at a bottom surface side, the box lid comprises an inner box lid provided at a box body side and covering the opening, and an outer box lid located outside the inner box lid, the humidity sensor circuit board is disposed in a space inside the box body;

the box body has a first sidewall and a second sidewall opposite to the first sidewall, wherein the first sidewall has a height larger than that of the second sidewall, the outer box lid is snapped to an outer surface of the second sidewall, and the inner box lid is snapped to an inner surface of the first sidewall.

2. The ventilating fan according to claim 1, wherein a sensing surface of the humidity sensor configured to detect the humidity of the air is perpendicular to the bottom surface.

3. The ventilating fan according to claim 2, wherein the outer box lid is provided with a first air inlet and the inner box lid is provided with a second air inlet;

the position of the first air inlet and the position of the second air inlet are offset from each other; and a space for allowing air to pass through is provided between the outer box lid and the inner box lid.

4. The ventilating fan according to claim 3, wherein a surface of the humidity sensor circuit board for installing the humidity sensor thereon is parallel to the sensing surface of the humidity sensor, positioning structures for fixing the humidity sensor circuit board are arranged inside the box body, and in a state that the humidity sensor circuit board is installed in a space inside the box body based on the positioning structures, the sensing surface of the humidity sensor is parallel to a surface for connecting the bottom surface to the top surface.

5. The ventilating fan according to claim 1, wherein an inner surface of the first sidewall of the box body is provided with a recess recessed toward an outside of the box body, and a sidewall of the inner box lid opposite to the first sidewall of the box body is provided with a protrusion that is snapped into the recess.

6. The ventilating fan according to claim 1, wherein an outer surface of the second sidewall of the box body is provided with a snap hook protruding toward an outside of the box body, and a sidewall of the outer box lid corresponding to the second sidewall of the box body is provided with a snap opening for engaging with the snap hook.

7. The ventilating fan according to claim 6, wherein, the snap hook comprises a detachment-preventing structure, in an engagement of the snap hook and the snap opening, the detachment-preventing structure is configured such that a force for releasing the engagement is much larger than a force for snapping the outer box lid onto the box body.

8. The ventilating fan according to claim 7, wherein the detachment-preventing structure comprises:

a tilting snap surface tilted away from the second sidewall in a direction from the air inlet to the air outlet; and a tilting detachment-preventing surface tilted away from the second sidewall in a direction from the air outlet to the air inlet;

the tilting detachment-preventing surface has a larger inclination with respect to the second sidewall than that of the tilting snap surface.

9. The ventilating fan according to claim 1, wherein the inner box lid presses the humidity sensor circuit board against the top surface of the humidity sensor box such that the humidity sensor circuit board is fixed thereon.

10. The ventilating fan according to claim 1 wherein the air outlet has two or more orifices and the diameter of the orifice is in a range of 1.5 mm to 2 mm.

* * * * *